US005249885A

United States Patent [19]

Florence

[11] Patent Number: 5,249,885

[45] **Date of Patent: * Oct. 5, 1993**

[54] METHOD OR USE OF COMPOSITE DRYWELL

[75] Inventor: Thomas Florence, Centerville, Mass.

[73] Assignee: Owl 1990 Trust, Hyannis, Mass.

[ * ] Notice: The portion of the term of this patent subsequent to Feb. 11, 2009 has been disclaimed.

[21] Appl. No.: 833,367

[22] Filed: Feb. 10, 1992

Related U.S. Application Data

[60] Division of Ser. No. 619,115, Nov. 28, 1990, Pat. No. 5,086,594, which is a continuation-in-part of Ser. No. 407,361, Sep. 14, 1989, Pat. No. 4,982,533, which is a continuation-in-part of Ser. No. 394,635, Aug. 16, 1989, Pat. No. 4,983,069.

[51] Int. Cl.[5] ..... E02B 13/00

[52] U.S. Cl. ..... 405/44; 405/43; 405/38; 405/36

[58] Field of Search ..... 405/43, 44, 50, 38, 405/36

[56] References Cited

U.S. PATENT DOCUMENTS

| | | | |
|---|---|---|---|
| 1,052,121 | 2/1913 | Austin | 405/44 |
| 4,260,284 | 4/1981 | Huart | 405/43 |
| 4,720,209 | 1/1988 | Iams | 405/36 |
| 4,919,568 | 4/1990 | Hurley | 405/43 |

*Primary Examiner*—Randolph A. Reese
*Assistant Examiner*—J. Russell McBee
*Attorney, Agent, or Firm*—Richard P. Crowley

[57] ABSTRACT

A composite drywell, a drywell system and method employing the composite drywell, which composite drywell comprises a cylindrical drywell having a removable top and bottom section, the drywell composed of a plurality of separate, edge-interlocked, arcuate sections which together form the cylindrical wall of the drywell, each arcuate section having a one side edge with a opening extending substantially the length of the side edge and the other side edge having a beaded side edge extending substantially the length of the arcuate section, the beaded edge of the arcuate section adapted to fit in an interlocking, receiving relationship into the other side edge opening of the adjacent arcuate section so as to have all arcuate sections interlocked to form a cylindrical drywell wall. At least one of the arcuate sections having a plurality of ports for the distribution of water from the cylindrical drywell and at least one large diameter hole, either on the top or the side wall, for the introduction of water to be distributed by the drywell.

17 Claims, 2 Drawing Sheets

METHOD OR USE OF COMPOSITE DRYWELL

This is a divisional of copending application Ser. No. 07/619,115 filed Nov. 28, 1990 now U.S. Pat. No. 5,086,594 which is a cip of of 407,361, filed 9/14/89, now U.S. Pat. No. 4,982,533 which is a cip of 394,635, filed 8/16/89, now U.S. Pat. No. 4,983,069.

BACKGROUND OF THE INVENTION

The control and flow of surface water, such as rain water, is important in preventing the build up of surface water adjacent foundations or other structures. Generally, drywells are employed to store large quantities of surface water therein and to discharge the surface water beneath the ground and away from a foundation, wall or structure and over a defined area. Typically, drywells are composed of a precast, concrete, generally cylindrical structure with a side wall hole of large diameter for an inlet pipe, and a plurality of smaller diameter holes usually uniformly distributed over a substantial part of the side walls and generally already precast in the cylindrical walls to permit the drainage of water radially outwardly from the drywell. The drywell would include a removable bottom cover and a top cover. The top cover may also have an opening therein in the top surface to serve as an open grate for receiving water.

Improved drywells, drywell systems and methods are described in my prior co-pending patent applications which are directed to the employment of a drywell, in one embodiment a plastic-type drywell wherein the side walls of the drywell have plastic knockout sections or have removable plugs therein so as to permit upon installation of the drywell beneath the ground the selection of the number and type of smaller diameter openings so as to control the direction and flow rate of the water from the drywell. In one embodiment, the plastic drywell wall contains a plurality of holes with weakened mechanical sections therein so that the sections may be knocked out, while in another embodiment there is a plurality of plugs used in plugging a selected number of the smaller diameter distribution ports so that the plugs may be easily installed in or removed from the side walls or distribution ports or the plastic knock-outs knocked out prior to use of the drywell so that the direction, level and distribution path of the flow of surface water discharged from the cylindrical wall of the drywell may be controlled.

One problem associated with the employment of prior art drywells as well as with my improved drywells and drainage systems as described in the prior co-pending applications is that such drywells, even if composed of a molded, hard plastic material, are bulky in nature and therefore not many drywells either of the precast concrete or the plastic variety, such as cylindrical drywells, may be carried to a job site due to the volume of the drywell. In addition, where precast concrete drywells are employed, the weight of the drywell is also an inhibiting factor with the transportation of the drywell.

Therefore, it is desirable to provide a new composite drywell and a drainage system employing the composite drywell and a method to control the direction and flow from the drywell wherein the drywell may be easily transported to the site and installed on the site, particularly where the drywell is composed of a plastic or molded polymer-type drywell which is lightweight so that a drywell may be easily transported and assembled on site.

SUMMARY OF THE INVENTION

The invention relates to a composite drywell, a drywell drainage system employing the composite drywell and a method of constructing the composite drywell and controlling the flow and direction of the surface water from the drywell.

The invention comprises a composite drywell, particularly a cylindrical-type drywell, for use in a drywell drainage system and method for the collection and distribution of surface water to a drain field and wherein the drywell comprises a plurality of separate, edge interlocking sections which form the peripheral wall of the body of the drywell and which drywell includes removable top and bottom sections. The particular sections which make up the drywell should include at least one section having a plurality of smaller diameter distribution ports therein, for example, from 1 to 2½ inches, and typically would include one section with a top inlet port in the top cover or a side wall large diameter inlet opening for the introduction of surface water. Optionally, the composite drywell would include a large diameter outlet port if desired to be interconnected to another drywell or another system receiving water.

The sections which compose the drywell may be all of the same type sections or may vary, for example, one section may contain a solid wall to prevent the flow of water in the particular direction of the solid wall section of the drywell or may contain solid wall containing a large diameter inlet or outlet port therein to receive surface water f rom that wall section only or may contain a section having a plurality of smaller diameter distribution ports to discharge surface water in the direction of the wall section, either all open or which ports may have, particularly if plastic, knock-out sections therein or have plugs installed therein so that the plugs may be either installed or removed to control the direction and flow of the water or the knock-out sections may be knocked out to open the selected distribution ports as in the prior pending application. Thus, control of the direction, flow and rate of the water may be controlled by the employment of the removable means in the distribution ports, that is, plugs or knock-outs, or by selection of a particular wall section which makes up the composite drywell. By way of example, but not to be restricted, the drywell may compose for example a solid wall section, together with another wall section having only a larger diameter inlet port and a wall section with a large number of smaller diameter distribution ports so that the flow of water will flow outwardly away from the section having the larger number of distribution ports.

The composite drywell employs wall sections which may be edge interlocked on site, whether these sections are of precast concrete or of molded plastic. A composite cylindrical drywell includes arcuate sections, these arcuate sections may be easily stacked and nestled against each other and carried to the job site and then assembled on site by interlocking the side edges to form the desired drywell thereby permitting a reduction in volume compared to the assembled drywell and a savings in transportation and permitting flexibility in assembling a particular drywell on a site.

The composite drywell may also be formed having a flanged bottom section which fits in a mating, engaging manner into the top section of adjacent drywells so that the composite drywells may be stacked vertically. The number of wall sections which would make up the particular drywell may vary as desired. For example, with a cylindrical drywell, the arcuate sections composing the drywell may be just merely two half sections which are interlocked together at their respective side edges or desirably would typically comprise arcuate one-third sections and may if desired be composed of arcuate sections of only one-fourth or one-fifth or less of the wall circumference. The arcuate sections may be mixed in any manner, so as to provide for the desired control of the direction and flow of the surface water in accordance with the drywell requirements.

In one embodiment, a composite cylindrical drywell with a removable top and bottom and having a lower, inwardly flanged section which permits the drywell to be stacked atop of adjacent drywells is composed of a plurality, for example, 2 to 4 separate, interlocked, arcuate wall sections, with each of the arcuate sections having a top, a bottom, a side wall and one and the other side edges. One side edge of each section has a generally open, arcuate, typically semicircular or slightly more so, side edge opening extending substantially the length of the one side edge, while the opposite, other side edge has a generally beaded or rounded side edge extending generally substantially the length of the side edge. The bead diameter is selected to fit in an interlocking, receiving relationship with the other side edge opening of an adjacent arcuate wall section so that the arcuate sections may be interlocked by adjacent edges to form the cylindrical wall of the composite drywell. The interlocking of the side edges of the drywell need not be in any particular manner, but merely sufficient to permit drywells to be installed on site and not to move during use, and therefore some water leakage is permitted. If desired, sealants, such as plastic or asphalt-type viscous materials, may be employed in the arcuate opening of the side edges to provide a sealed, watertight, interlocking relationship where the absolute sealing of the interlocked side edges is desirable.

The composite drywell is employed in a drywell drainage system and would include a water source of surface water or other water to be collected and to be subterranneally flow distributed away from the water source together with the composite drywell positioned beneath the ground and having either a top inlet or a side wall large diameter inlet port to receive the surface water. The drywell has at least on one of the arcuate wall sections a plurality of distribution ports typically having a smaller diameter than the said large diameter ports into which the water is introduced, and a removable bottom cover and top cover and with the arcuate sections so selected, together with the employment of removable means with the distribution ports, to control the direction, level and distribution pattern of the water and with the source of the water connected by an underground pipe to the drywell.

The composite drywell are formed on site after transport of the arcuate sections which may be for example nestled together to reduce volume, and typically where they are plastic may be of light weight and may be easily handled on the job site, and the sections merely placed together in the ground typically by placing one open edge adjacent the other beaded edge and pushing the sections together. Where the arcuate opening extends less than 180°, so that lateral removal or assembly cannot occur then the arcuate section may be interlocked by sliding the beaded edge downwardly into the side edge opening or vice versa or snap-fitted together with lateral force with adjacent arcuate sections assembled until the peripheral wall of the composite drywell is completed using the selected sections.

The direction, level and distribution pattern of the flow of surface water discharged from the cylindrical wall of the composite drywell is therefore controlled by the selection of the opening of the smaller distribution ports and also in combination with the selection of the particular arcuate sections employed in making up the composite drywell. For example, if subterranean flow of the water is to be prevented in a direction toward the foundation of a house, then a solid arcuate section of the composite drywell may be used in the house direction so that the water is directed away from the foundation wall, while the opposite arcuate section may be composed of a large number of distribution ports to permit the outward flow of water from such distribution ports.

The composite drywell of the arcuate sections typically are composed of the same type of materials, although precast concrete or plastic arcuate sections can be intermixed providing the beaded and opening side edges are compatible. However, typically the composite drywell is composed of a precast concrete, or more particularly, a molded plastic, such as polypropylene or polyethylene, which may be reinforced if desired with the side edge beading and openings all premolded so there is a reduction in cost and the lightweight sections may be easily handled and assembled on the job site.

The invention will be described for the purposes of illustration only on or in connection with certain illustrated embodiments; however, it is recognized that those persons skilled in the art may make various changes, modifications, additions and improvements to the illustrated embodiments, all falling within the spirit and scope of the invention.

DESCRIPTION OF THE EMBODIMENTS

Figure 1:
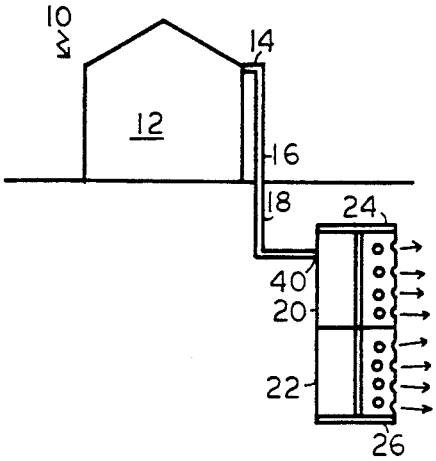
FIG. 1 is an illustrative, schematic view of a drainage system employing the composite drywell of the invention.

FIG. 1 shows a schematic illustration of an improved drywell drainage system 10 having a house 12 with a gutter 14 and a drainpipe 16 which leads into an underground connecting pipe 18 which connects beneath the ground 28 to the top inlet port of a pair of vertically stacked composite drywells of the invention 20 and 22 having a removable top cover 24 and a bottom cover 26. The flow direction of the surface water from the composite stacked drywells is illustrated by arrows.

Figure 2:
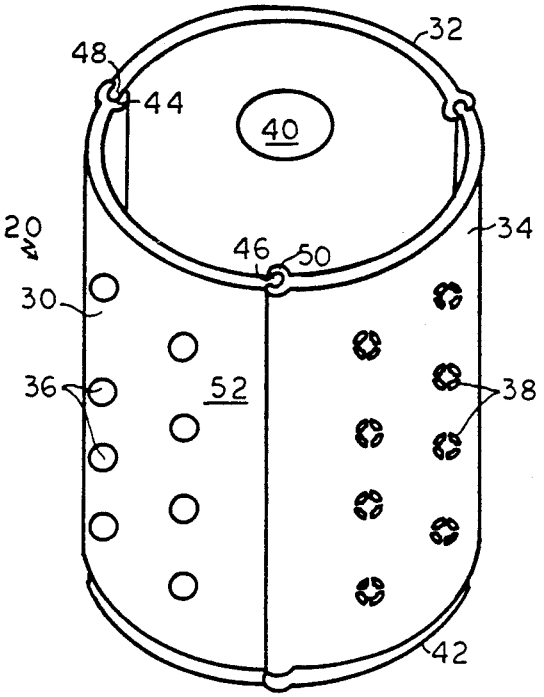
FIG. 2 is a perspective, partially exploded view of a composite drywell of the invention.
Figure 3:
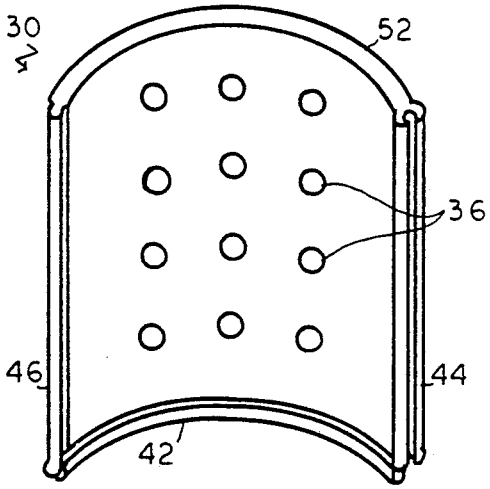
FIG. 3 is a side plan view of an arcuate section of the composite drywell of the invention of FIG. 2.
Figure 4:
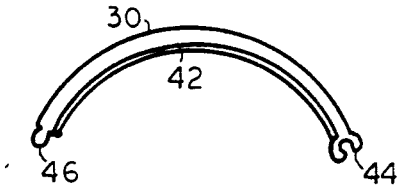
FIG. 4 is a top plan view of the arcuate section of FIG. 3.

FIG. 2 is a perspective, exploded view of a composite drywell 20 of FIG. 1 composed of three separate, interlocked, arcuate sections 30, 32 and 34 with arcuate sections 30 and 34 being similar, while arcuate section 32 has a solid wall with a one large diameter, for example, 4 to 8 inch inlet opening 40 at the upper portion thereof. Sections 30 and 34 have a plurality of small distribution ports 36 with knock-out sections or plugs 38 in some of the ports to prevent the f low of water, while other ports 36 are open. Each of the arcuate sections 32 and 34 have a flanged-type offset bottom 42, the flange wall section having a thinner wall section and spaced inwardly so that it fits within the upper wall section of an adjacent composite or other drywell 22 to permit vertical stacking of the composite drywells. As illustrated (see FIGS. 3 and 4), arcuate section 30 has a semicircular opening 44 along one side edge thereof, as illustrated, of about 160° to 170° opening and a rounded, beaded portion 46 on the other opposite side edge thereof interlocked within opening 44, while section 32 has a similar arcuate opening 48 which interlocks with the beaded section 46 of the adjacent arcuate section 30, while arcuate section 34 has a rounded beaded portion 50 which fits within the arcuate opening 44 of section 30. As illustrated more particularly in FIGS. 3 and 4, the arcuate opening extends, so that the arcuate sections are assembled by sliding downwardly in a vertical manner the beaded portion 46 within the arcuate section 50 in the adjacent opening or snapping in the beaded portion into each adjacent opening where the dimensions are so arranged. In this manner, the arcuate sections are interlocked together to form the peripheral wall of the drywell 20. However, if desirable, the arcuate side edge opening which generally extends the length of the arcuate section, as does the beaded section, may be semicircular or greater so that the beaded portion merely just can be laterally moved into an interlocking position and retained in place by the surrounding earth pushing inwardly to hold the composite drywell together or by adhesive sealants or gaskets in the openings.

Figure 5:
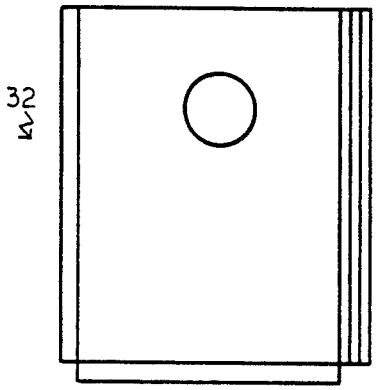
FIGS. 5, 6, 7 and 8 are side elevational views of various arcuate sections which may be used in the composite drywell of the invention.
Figure 6:
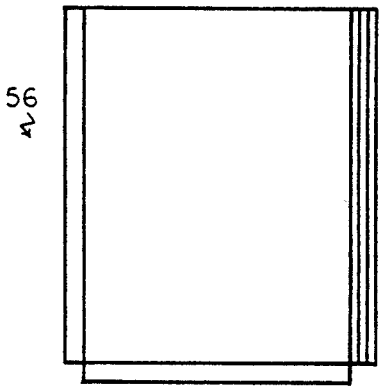
Figure 7:
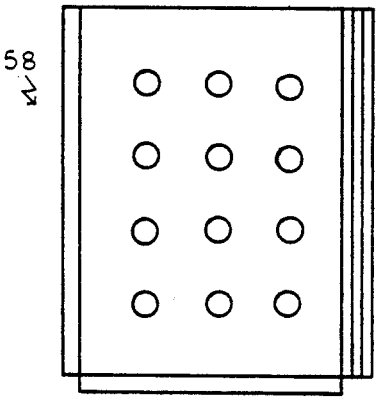
Figure 8:
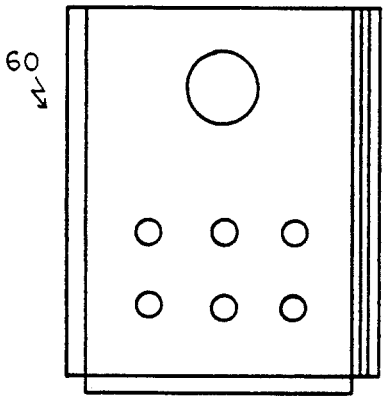

FIGS. 5–8 are directed toward various arcuate sections 32, 56, 58 and 60 which for example may be assembled together to form the peripheral wall of a composite drywell. As illustrated, the arcuate sections represent an arcuate section of one-third of a cylindrical drywell; however, they may comprise any portion of the arcuate section of the drywell circumference. FIG. 5 shows an arcuate section with a solid wall section having a large inlet or outlet opening 40 in the upper wall portion thereof. FIG. 6 represents arcuate section 56 having a solid arcuate wall. FIG. 7 represents an arcuate section 58 having a plurality of small diameter, uniformly spaced apart distribution ports in the wall portion thereof, while FIG. 8 represents an arcuate section 60 having a plurality of distribution ports substantially extending throughout the arcuate wall and having a large diameter inlet or outlet port at the upper wall portion thereof.

Figure 9:
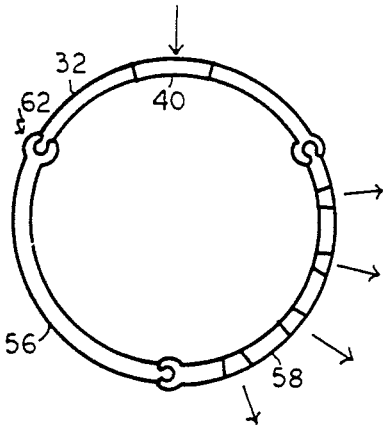
FIGS. 9 and 10 are top plan views of composite drywells of the invention employing various arcuate sections.
Figure 10:
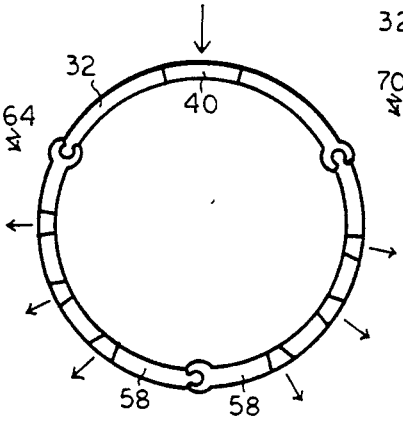

FIGS. 9 and 10 represent composites of arcuate sections of FIGS. 5–8 to illustrate how the control of water may be made by selecting particular arcuate sections. FIG. 9 shows a drywell 62 composed of interlocked arcuate sections 32, 56 and 58. FIG. 10 shows drywell 64 composed of arcuate sections 32, 56 and 58 which illustrates that by selecting the arcuate sections the water can be distributed from the drywell for example as illustrated by the flow arrows in the top plan view in FIGS. 9 and 10.

Figure 11:
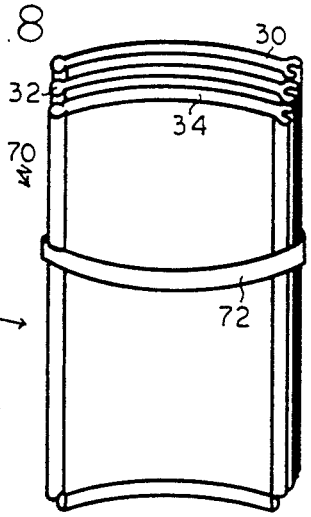
FIG. 11 is a side plan view of arcuate sections in a stacked, nestled relationship.

FIG. 11 shows arcuate sections 30, 32 and 34 of a lightweight molded plastic stacked in a nestling, low volume relationship and retained together by unending metal or plastic strap 72 to form a lightweight, easily transportable package 70 for transportation to a job site.

Thus, as illustrated, the extent, rate and direction of the flow of surface water from a composite drywell may be controlled by selecting the ports to be opened or by selecting the arcuate sections or by a combination thereof all to provide a new and improved composite drywell and drywell drainage system and method.

What is claimed is:

1. A method for the accumulation and control-flow of water from a water source, which method comprises:
   a) providing a composite drywell having a side wall, the drywell adapted to receive water therein, the drywell comprising a plurality of sections which makes up the side wall, at least one of which sections contains a plurality of distribution ports therein, for the distribution of water from the drywell, and which drywell includes a top cover;
   b) interlocking together the side edges of the adjacent sections of the drywell, to form the side wall of the composite drywell; and
   c) selecting at least one of the particular sections, to form the composite drywell, to provide the desired direction, level and distribution flow of the water from the distribution ports of the composite drywell.

2. The method of claim 1 which includes interlocking the side edges of the sections, by snapping a beaded side edge of one section into a side-edge opening of another adjacent section.

3. The method of claim 1 which includes interlocking the side edges of the sections by vertically sliding a beaded side edge of one section into a side-edge opening of an adjacent section.

4. The method of claim 1 which includes receiving the sections at a job site in a stacked relationship, and employing the sections on the job site, by interlocking the side edges, to form the composite drywell.

5. The method of claim 1 wherein the sections comprise arcuate sections, and wherein from two to five sections are edge interlocked, to form a cylindrical composite drywell.

6. The method of claim 1 which includes selecting at lest one section which contains a plurality of distribution ports in the side wall of the section, and which includes mechanically weakened sections in the distribution ports, and which method includes removing one or more of the weakened mechanical sections in the arcuate section, to control the flow of water from the composite drywell.

7. The method of claim 1 which includes interlocking together three arcuate sections, to form a cylindrical composite drywell.

8. The method of claim 1 which includes selecting at least one section, which contains a large-diameter inlet port, for the receipt of water.

9. The method of claim 1 wherein the composite drywell has a lower flange section, and which method includes vertically stacking one composite drywell, having the lower flange section, in a mating stocked relationship on top of another composite drywell.

10. The method of claim 1 wherein the sections making up the composite drywell are selected from the group consisting of: a solid wall; a solid wall with a large-diameter port opening; a solid wall having a plurality of smaller-diameter distribution ports having a weakened mechanical section therein which may be removed; a solid wall having a plurality of smaller-diameter distribution ports with removable plugs therein; a solid wall having a plurality of smaller-diameter distribution ports in the solid-wall section, and having a large-diameter inlet opening; and a solid wall having a plurality of generally uniformly distributed, open, small-diameter distribution ports to form the composite drywell.

11. The method of claim 1 which includes connecting the composite drywell to a source of water.

12. The method of claim 1 which includes providing a plurality of arcuate sections, to form the composite drywell, the arcuate sections formed of polyethylene or polypropylene material.

13. The method of claim 1 which includes employing sealants on the interlocked side edges, to provide a sealed composite drywell.

14. The method of claim 1 to a drainage field.

15. A method for the accumulation and control-flow of surface water from a surface-water source, which method comprises:

a) providng a composite, cylindrical drywell composed of a molded plastic and having a cylindrical side wall, the drywell adapted to receive surface water therein for distribution, the drywell comprising a plurality of two to five arcuate sections, to form the composite sidewall, at least one of which sections contains a plurality of distribution ports therein, having weakened mechanical sections subject to be removed, the distribution ports adapted for the distribution of water from the composite drywell, and which drywell includes a bottom cover and a top cover;

b) interlocking the side edges of adjacent arcuate sections, to form a cylindrical side wall of the drywell; and c) selecting at least one of particular arcuate sections to form the cylindrical composite drywell, to provide for the desired direction, level and distribution flow of the surface water from the distribution ports of the composite drywell.

16. The method of claim 15 which includes stacking in a nestling relationship the arcuate sections, and receiving the stacked, nestled, arcuate sections at a job site, and employing the arcute sections on the job site, to form the composite drywell.

17. The method of claim 15 which includes interlocking the side edges by sliding a rounded beaded edge of one arcuate section into an open bead-receiving edge of an adjacent arcuate section.

* * * * *

UNITED STATES PATENT AND TRADEMARK OFFICE

CERTIFICATE OF CORRECTION

PATENT NO. : 5,249,885

DATED : October 5, 1993

INVENTOR(S) : Thomas Florence

It is certified that error appears in the above-identified patent and that said Letters Patent is hereby corrected as shown below:

Cover Page

[54] Delete "OR" and insert --OF--.

[60] Delete "Division" and insert "Continuation".

Claim 9

Col. 6, line 63, delete "stocked" and insert --stacked--.

Claim 14

Col. 7, line 20, after "claim 1" insert --wherein the water source comprises surface water, and which includes directing the surface water into the composite drywell, for distribution--.

Claim 15

Col. 8, line 2, delete "sidewall" and insert --side wall--.

Claim 16

Col. 8, line 21, delete "arcute" and insert --arcuate--.

Signed and Sealed this

Sixth Day of June, 1995

Bruce Lehman

*Attest:*

BRUCE LEHMAN

*Attesting Officer*

*Commissioner of Patents and Trademarks*